US008131171B2

(12) United States Patent
Ohshima et al.

(10) Patent No.: US 8,131,171 B2
(45) Date of Patent: Mar. 6, 2012

(54) SHEET LENGTH MEASUREMENT APPARATUS AND IMAGE FORMING APPARATUS

(75) Inventors: Minoru Ohshima, Kanagawa (JP); Kazuyuki Tsukamoto, Tokyo (JP); Takao Furuya, Kanagawa (JP); Yoshinari Iwaki, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 206 days.

(21) Appl. No.: 12/706,069

(22) Filed: Feb. 16, 2010

(65) Prior Publication Data

US 2011/0020020 A1 Jan. 27, 2011

(30) Foreign Application Priority Data

Jul. 21, 2009 (JP) ..... 2009-169919

(51) Int. Cl.
*G03G 15/00* (2006.01)

(52) U.S. Cl. ..... 399/45; 399/389

(58) Field of Classification Search ..... 399/16, 399/45, 389
See application file for complete search history.

(56) References Cited

U.S. PATENT DOCUMENTS 5,678,127 A * 10/1997 Suga ..... 399/45
2010/0329759 A1* 12/2010 Furuya et al. ..... 399/389

FOREIGN PATENT DOCUMENTS

JP 05-208534 A 8/1993
JP 2003-171035 A 6/2003
JP 2005-345167 A 12/2005

* cited by examiner

*Primary Examiner* — Hoang Ngo
(74) *Attorney, Agent, or Firm* — Sughrue Mion, PLLC

(57) ABSTRACT

A sheet length measurement apparatus including: a rotating member that comes in contact with a recording sheet conveyed on a conveying path, and rotates along with the conveyance of the recording sheet; a rotation amount detector that detects a rotational amount of the rotating member; a fixing support member that fixedly supports an rotating shaft of the rotating member at a fixed position; an opposed member that is disposed opposite to the rotating member so as to hold the recording sheet between the rotating member and the opposed member, the opposed member being disposed so that the rotating member rotates along with the conveyance of the recording sheet; and a support member that supports the opposed member in a movable state in a direction to separate from or come in contact with a surface of the recording sheet.

6 Claims, 15 Drawing Sheets

L1:ERROR

L2:CALCULATION FROM ROTATIONAL AMOUNT OF ENCODER DEVICE

L3:ERROR

L4:DISTANCE BETWEEN EDGE SENSORS

SHEET LENGTH MEASUREMENT APPARATUS AND IMAGE FORMING APPARATUS

CROSS-REFERENCE TO RELATED APPLICATION

This application is based on and claims priority under 35 USC 119 from Japanese Patent Application No. 2009-169919 filed Jul. 21, 2009.

BACKGROUND (i) Technical Field

The present invention relates to a sheet length measurement apparatus and an image forming apparatus.

(ii) Related Art

Conventionally, there has been known a technique that detects a length of a sheet on which an image is formed.

SUMMARY

According to an aspect of the present invention, there is provided a sheet length measurement apparatus including: a rotating member that comes in contact with a recording sheet conveyed on a conveying path, and rotates along with the conveyance of the recording sheet; a rotation amount detector that detects a rotational amount of the rotating member; a fixing support member that fixedly supports an rotating shaft of the rotating member at a fixed position; an opposed member that is disposed opposite to the rotating member so as to hold the recording sheet between the rotating member and the opposed member, the opposed member being disposed so that the rotating member rotates along with the conveyance of the recording sheet; and a support member that supports the opposed member in a movable state in a direction to separate from or come in contact with a surface of the recording sheet.

BRIEF DESCRIPTION OF THE DRAWINGS

Exemplary embodiments of the present invention will be described in detail based on the following figures, wherein.

DETAILED DESCRIPTION

Figure 1:
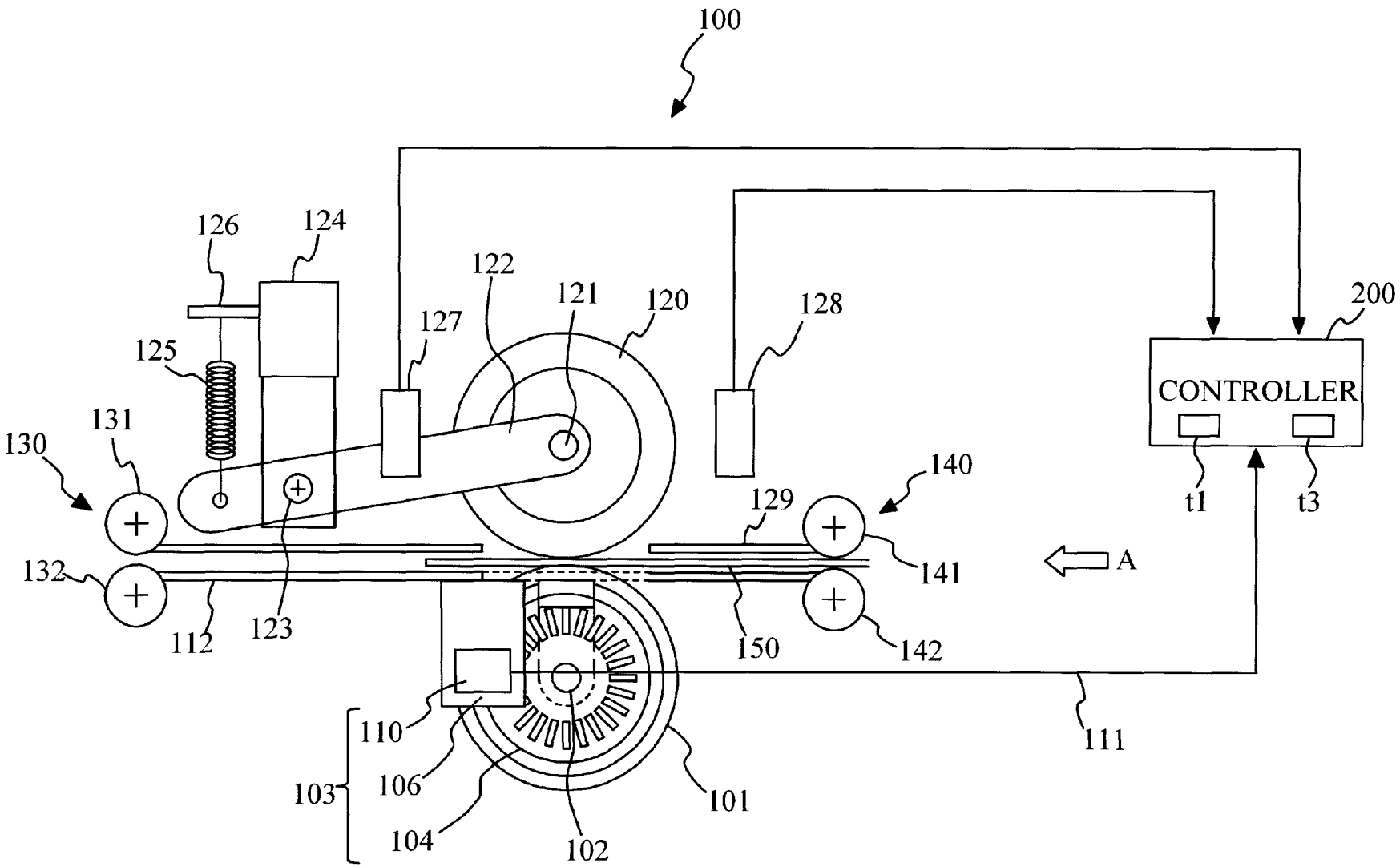
FIG. 1 is a diagram showing an example of a construction of a sheet length measurement apparatus.

A description will now be given, with reference to the accompanying drawings, of an exemplary embodiment of the present invention.

First Exemplary Embodiment

First, a description will be given of a construction of an exemplary embodiment, with reference to FIG. 1. A sheet length measurement apparatus 100 of the exemplary embodiment includes a length measurement roll 101 that is provided for the measurement of a sheet length, and an opposed roll 120 that is opposed to the length measurement roll 101.

The length measurement roll 101 holds a sheet (i.e., a record sheet) 150 conveyed on a conveying path between the opposed roll 120 and the length measurement roll 101, and rotates according to the conveyance of the sheet 150. The opposed roll 120 comes in contact with the length measurement roll 101 by a given nip pressure so that the length measurement roll 101 rotates according to the conveyance of the sheet 150.

Sheets having various thickness are conveyed to the sheet length measurement apparatus 100. To measure the sheet length while giving an appropriate nip pressure to all of the sheets, it is necessary for any one of the length measurement roll 101 and the opposed roll 120 to be supported in a movable state in a direction to separate from or come in contact with a surface of the sheet 150. In the exemplary embodiment, the opposed roll 120 is supported in a state where the opposed roll 120 can swing, but the details thereof are described later.

The length measurement roll 101 is composed of a hollow cylindrical shape, and includes a rotating shaft 102 at the center of the length measurement roll 101. An encoder device 103, which is an example of a detection means detecting a rotational amount of the length measurement roll 101, is provided around the length measurement roll 101 and the rotating shaft 102. The encoder device 103 outputs a pulse signal whenever the length measurement roll 101 rotates by a given angle. The pulse signal output from the encoder device 103 is transmitted to a controller 200, described below. The details of the encoder device 103 are described later while referring to FIGS. 2A and 2B.

The opposed roll 120 is composed of a hollow cylindrical shape, and includes a rotating shaft 121 at the center of the opposed roll 120. The rotating shaft 121 of the opposed roll 120 is rotatably installed in one end of a swinging arm 122. Another end of a swinging arm 122 is installed in a swinging arm support member 124 with a swinging shaft 123 in a state where the swinging arm 122 can swing. The opposed roll 120 is supported in a movable state in a direction to separate from or come in contact with the surface of the sheet 150, with the swinging arm 122 and the swinging arm support member 124. Also, the opposed roll 120 is swingably supported by centering on the swinging shaft 123, with the swinging arm 122 and the swinging arm support member 124. The swinging arm support member 124 is fixed to a housing, not shown, of the sheet length measurement apparatus 100.

One end of a coil spring 125 is installed in a leading end of the swinging arm 122 located at the outside of the swinging shaft 123. Another end of the coil spring 125 is installed in an arm 126 extended from the swinging arm support member 124. The coil spring 125 is in an extended state, and generates a force to rotate the swinging arm 122 in a clockwise direction of FIG. 1. The coil spring 125 applies the force of the clockwise direction of FIG. 1 to the swinging arm 122, so that the opposed roll 120 is pressed against the length measurement roll 101 by a given pressure.

A lower chute 112 and an upper chute 129 are disposed in opposite directions, and provided along the conveying path conveying the sheet 150. The upper chute 129 is disposed so as to provide a predetermined gap away from the lower chute 112. The lower chute 112 and the upper chute 129 have a role to restrict the conveyance of the sheet 150 so that the sheet 150 does not deviate from the conveying path. The sheet 150 is conveyed while coming in contact with the lower chute 112, and further receives the restriction of the upper chute 129 so as not to be displaced upward.

The sheet 150 is a record material of the sheet shape, and a paper material to form an image. Besides the paper material, a sheet made of a resin used for an OHP sheet, and a sheet in which the coating of a resin film is given to a surface of the paper material can be used as the record material.

The sheet length measurement apparatus 100 includes two edge sensors. An edge sensor installed at the left of the opposed roll 120 shown in FIG. 1 is referred to as "an upstream edge sensor 127", and an edge sensor installed at the right of the opposed roll 120 is referred to as "a downstream edge sensor 128". The sheet 150 is conveyed on the conveying path from a side of the upstream edge sensor 127 to that of the downstream edge sensor 128. A left side of the length measurement roll 101 and the opposed roll 120 (i.e., a side of the upstream edge sensor 127) is referred to as "an upstream side", and a right side of the length measurement roll 101 and the opposed roll 120 (i.e., a side of the downstream edge sensor 128) is referred to as "a downstream side". The upstream edge sensor 127 and the downstream edge sensor 128 are photoelectronic sensors, each of which is composed of a LED (Light Emitting Diode) and a photo sensor. Each of the upstream edge sensor 127 and the downstream edge sensor 128 optically detects the passage of the sheet 150 to be conveyed, at a detection position of the sheet 150. The detection position is a light irradiation position of the LED. Sensor signals output from the upstream edge sensor 127 and the downstream edge sensor 128 are transmitted to the controller 200. Each of the sensor signals becomes "ON" when each of the upstream edge sensor 127 and the downstream edge sensor 128 detects the sheet 150.

The sheet length measurement apparatus 100 includes an upstream conveying roll 130 provided on the upstream side of a sheet conveying direction, and a downstream conveying roll 140 provided on the downstream side of the sheet conveying direction. The upstream conveying roll 130 is disposed at the upstream side of the upstream edge sensor 127, and the downstream conveying roll 140 is disposed at the downstream side of the downstream edge sensor 128. The upstream conveying roll 130 includes conveying rolls 131 and 132 as a pair of rolls. Similarly, the downstream conveying roll 140 includes conveying rolls 141 and 142 as a pair of rolls. The conveying roll 131 of the upstream conveying roll 130 and the conveying roll 141 of the downstream conveying roll 140 are driven with a motor, not shown. The conveying roll 132 and the conveying roll 142 rotate by receiving driving forces of the conveying roll 131 and the conveying roll 141, respectively.

The controller 200 is a computer, and has timers t1 and t3, described later. The controller 200 has a function that calculates the length of the sheet 150 in the conveying direction and a function as a control device of an image forming apparatus, described later. The details of these functions are described later.

Next, a detailed description will be given of the length measurement roll 101 and the encoder device 103 disposed around the length measurement roll 101, with reference to FIGS. 2A and 2B. FIG. 2A shows configurations of the length measurement roll 101 and the opposed roll 120, as viewed from a direction of an arrow A shown in FIG. 1. FIG. 2B shows configurations of a front face and a side face of the length measurement roll 101, and a rotation amount detector 105 included in the encoder device 103.

First, a description will be given of the length measurement roll 101, with reference to FIG. 2A. The length measurement roll 101 in which the encoder device 103 is installed always fixes the rotating shaft 102 at a fixed position with a support member 107. Although the rotating shaft 121 of the opposed roll 120 can swing according to the conveyance of the sheet 150, the rotating shaft 102 does not swing since the length measurement roll 101 always fixes the rotating shaft 102 at the fixed position. The support member 107 is fixed to a housing, not shown, of the length measurement roll 101.

Next, a description will be given of the encoder device 103. The encoder device 103 includes an encoder wheel 104, the rotation amount detector 105, an encoder substrate 106, and an electronic device 110 formed on the encoder substrate 106 (see FIG. 1 with reference to the electronic device 110). The rotation amount detector 105 includes a light source unit for rotational detection 108, and a light detection unit for rotational detection 109. The encoder wheel 104 is installed in the rotating shaft 102 of the length measurement roll 101 as shown in FIG. 2A, and rotates by the rotation of the rotating shaft 102 (i.e., the length measurement roll 101). The encoder wheel 104 has a pattern in which slit type optical penetration parts and slit type shading parts are alternately formed along a circumference of the encoder wheel 104 (see the front view of FIG. 2B).

The light source unit for rotational detection 108 emits a light (i.e., parallel light rays) from a light source (not shown) toward the encoder wheel 104 by the control of the electronic device 110 on the encoder substrate 106. The light detection unit for rotational detection 109 holds the encoder wheel 104 between the light source unit for rotational detection 108 and the light detection unit for rotational detection 109, and is disposed in a position opposite to a position of the light source unit for rotational detection 108, as shown in FIG. 2B. Further, the light detection unit for rotational detection 109 is disposed on an optical axis of the light emitted from the light source unit for rotational detection 108. The light detection unit for rotational detection 109 detects the light which is emitted from the light source unit for rotational detection 108 and penetrated through the encoder wheel 104. The light detection unit for rotational detection 109 outputs a rotation signal depending on the detected light to the electronic device 110. The electronic device 110 is connected to the controller 200 via a wiring harness 111 (see FIG. 1). The electronic device 110 outputs the rotation signal output from the light detection unit for rotational detection 109 to the controller 200 via the wiring harness 111.

Figure 3A:
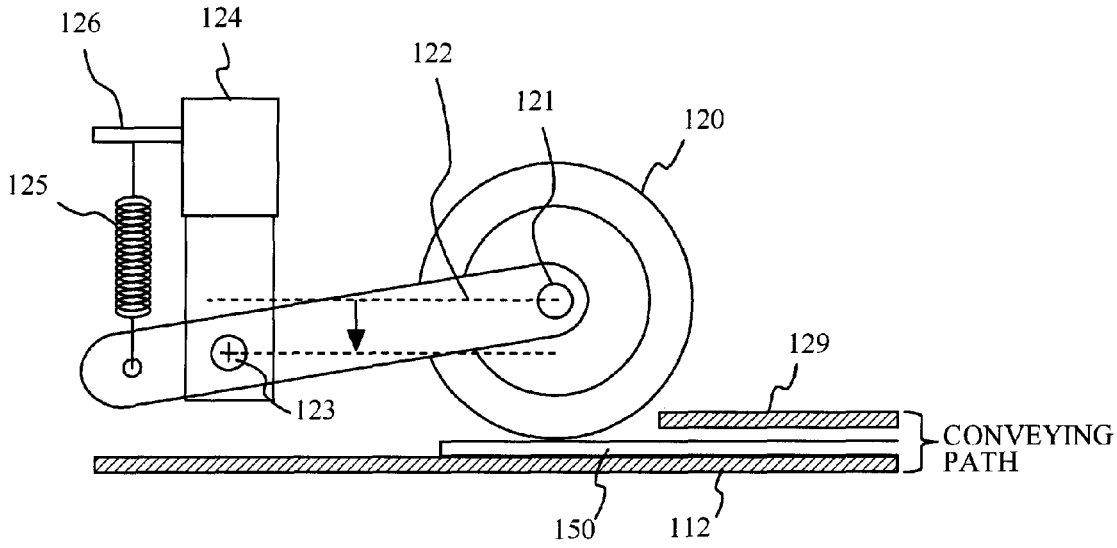
FIGS. 3A and 3B are diagrams showing examples of a construction of a support member supporting the opposed roll.

FIG. 3A shows a construction of a support member that swingably supports the opposed roll 120. A position in a vertical direction of the swinging shaft 123 of the swinging arm 122 included in the support member is below a position in a vertical direction of the rotating shaft 121 which is a joint point of the swinging arm 122 and the opposed roll 120. That is, the position in the vertical direction of the swinging shaft 123 is closer or nearer to the conveying path than the position in the vertical direction of the rotating shaft 121. Here, the vertical direction indicates a vertical direction to the surface of the sheet 150 conveyed to the conveying path. A description will be given of a reason to adopt such a construction, with reference to FIG. 4A.

Figure 4A:
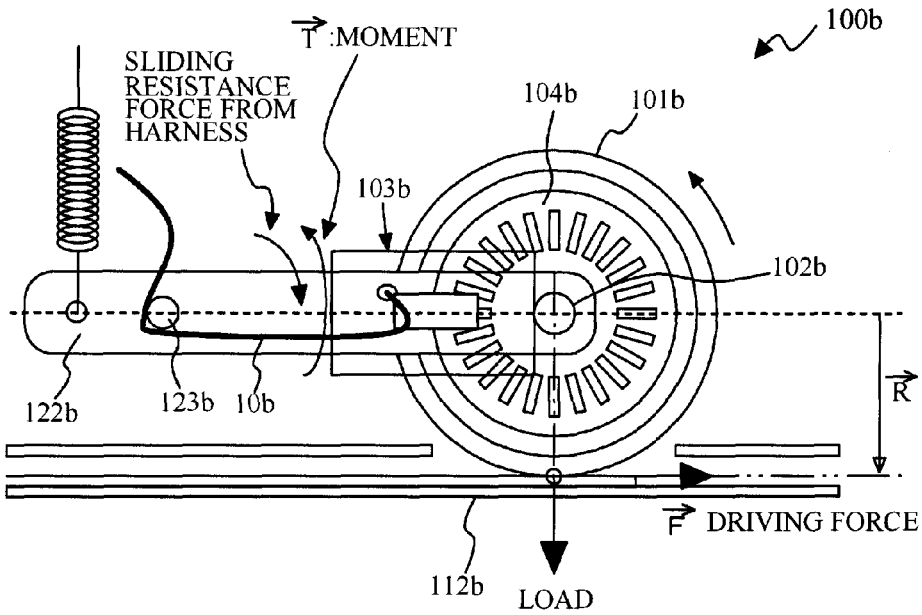
FIG. 4A RELATED ART
FIG. 4A is a diagram showing a construction of a conventional sheet length measurement apparatus.

FIG. 4A shows a construction of a conventional construction in which an encoder device 103*b* is provided on a swinging arm 122*b* in which a length measurement roll 101*b* is installed. The swinging arm 122*b* swingably supports the length measurement roll 101*b* by centering a swinging shaft 123*b*.

In a case where the length measurement roll 101*b* is swingably supported, when the length measurement roll 101*b* comes in contact with the conveyed sheet 150, a moment of the force occurs in the length measurement roll 101*b* by a force received from the sheet 150. The moment of the force which the length measurement roll 101*b* receives from the sheet 150 on the conveying path is as follows. It is assumed that a distance between the swinging shaft 123*b* and a contact point is "R", and the contact point is a point where the length measurement roll 101*b* comes in contact with the conveying path (i.e., the lower chute 112), as shown in FIG. 4A. It is also assumed that a driving force which the length measurement roll 101*b* receives from the sheet 150 on the conveying path is "F (vector quantity)". The moment of the force is calculated by the cross product of "R" and "F". A direction of the driving force which the length measurement roll 101*b* receives from the sheet 150 on the conveying path is parallel to the conveying path, and identical with the conveying direction of the sheet 150, as shown in FIG. 4A. Therefore, when the position in the vertical direction of the swinging shaft 123*b* is below the position in the vertical direction of the rotating shaft 102*b* which is the joint point of the swinging arm 122*b* and the length measurement roll 101*b*, a value of the distance "R" decreases, compared to the case where the position in the vertical direction of the swinging shaft 123*b* is above the position in the vertical direction of the rotating shaft 102*b*. Thereby, the moment of the force which the length measurement roll 101*b* receives from the sheet 150 decreases.

Figure 4B:
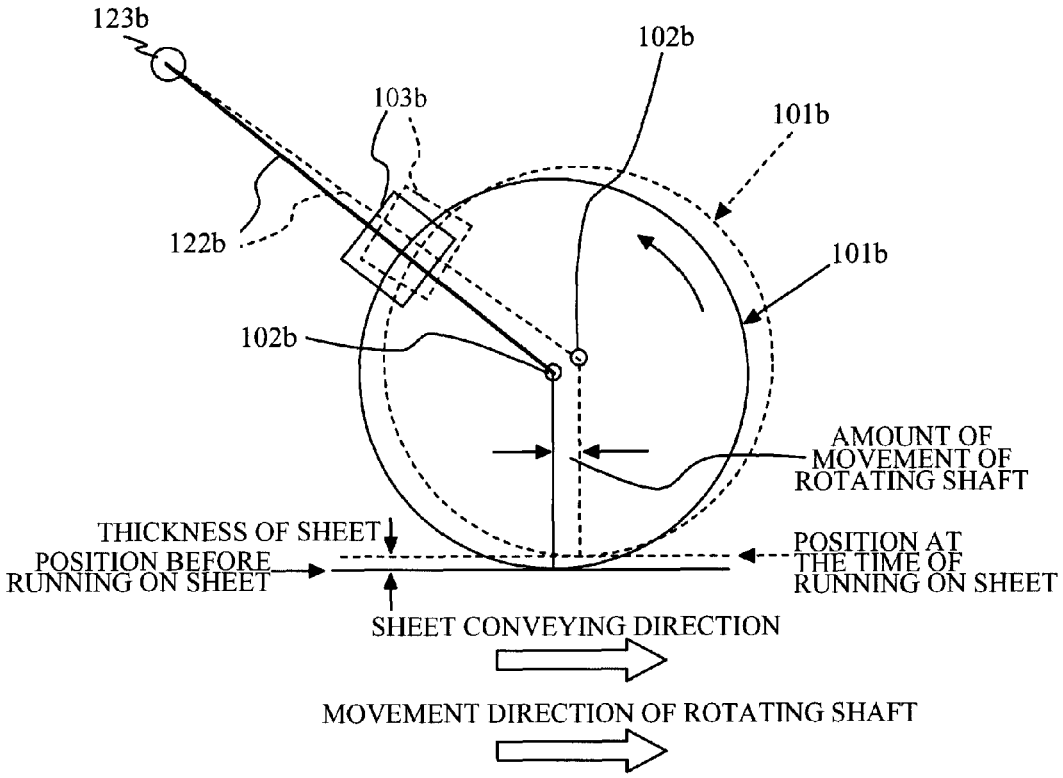
RELATED ART FIG. 4B
FIG. 4B is a diagram useful in explaining the movement of a rotating shaft of the length measurement roll when the length measurement roll has run onto a sheet.

However, when the position of the swinging shaft 123*b* is not level with that of the rotating shaft 102*b*, and the swinging arm 122*b* is supported slantwise, a problem occurs as follows. FIG. 4B shows the case where the position in the vertical direction of the swinging shaft 123*b* is higher than the position in the vertical direction of the rotating shaft 102*b*. In FIG. 4B, the thickness of the sheet 150 to the size of the length measurement roll 101*b* is exaggeratingly shown for convenience of easy explanation. In the case where the swinging arm 122*b* is supported slantwise as shown in FIG. 4B, when the length measurement roll 101*b* runs onto the sheet 150, the rotating shaft 102*b* of the length measurement roll 101*b* moves at the rear of the sheet conveying direction by the rotation of the length measurement roll 101*b*. The position of the length measurement roll 101*b* before the length measurement roll 101*b* runs onto the sheet 150 is shown in a solid line of FIG. 4B, and the position of the length measurement roll 101*b* after the length measurement roll 101*b* runs onto the sheet 150 is shown in a broken line of FIG. 4B. The distance to the rear side of the rotating shaft 102*b* influences a measurement value of the length of the sheet 150 as a measurement error. To prevent the rotating shaft 102*b* from moving to the rear side, it is necessary to support the swinging arm 122*b* horizontally as shown in FIG. 4A. That is, the construction to weaken the moment of the force applied to the length measurement roll 101*b*, and the construction to decrease a length measurement error of the length measurement roll 101*b* are in an antithetical relationship.

However, in the exemplary embodiment, the encoder device 103 is installed in the length measurement roll 101 that fixes the rotating shaft 102 at the fixed position. Therefore, the rotating shaft 102 does not move at the rear of the sheet conveying direction even when the length measurement roll 101 runs onto the sheet 150. Further, since the position in the vertical direction of the swinging shaft 123 of the swinging arm 122 supporting the opposed roll 120 is below the position in the vertical direction of the rotating shaft 121 of the swinging arm 122, as described above, the moment of the force applied to the opposed roll 120 decreases, compared to the case where the position in the vertical direction of the swinging shaft 123 is above the position in the vertical direction of the rotating shaft 121. Thereby, the vibration of the opposed roll 120 according to the conveyance of the sheet 150 is decreased. As a result, the change of the nip pressure between the opposed roll 120 and the length measurement roll 101 can be controlled, and the length measurement roll 101 can accurately follow the conveyance of the sheet 150 to rotate.

In the construction of the conventional sheet length measurement apparatus 100*b* shown in FIG. 4A, the encoder device 103*b*, a wiring harness 10*b*, and so on are provided on the swinging arm 122*b*. The wiring harness 10*b* transmits a rotation signal indicative of a rotational amount of the length measurement roll 101*b* to the controller 200. Therefore, when a rotational amount of an encoder wheel 104*b* is detected, a micro vibration caused by the swing of the length measurement roll 101*b* appears as a noise. Also, since the encoder device 103*b* is provided on the swinging arm 122*b*, the inertia of the swinging arm 122*b* increases by only the weight of encoder device 103*b*. Further, the wiring harness 10*b* wired on the swinging arm 122*b* becomes a sliding resistance, the fluctuation in the load of the length measurement roll 101*b* is caused. The load is a force which the length measurement roll 101*b* gives to the sheet 150 touching the length measurement roll 10 lb. When the fluctuation in the load is caused, the length measurement roll 101*b* slips, to thereby influence the measurement accuracy of the sheet length.

However, in the exemplary embodiment, the rotating shaft 102 of the length measurement roll 101 including the encoder device 103 is fixed at the fixed position as shown in FIG. 2A, and the opposed roll 120 opposite to the length measurement roll 101 is swung. Thereby, the length measurement roll 101 does not swing, and hence the inertia to be generated is decreased.

Also, since the length measurement roll 101 does not swing, the wiring harness 111 never works as the sliding resistance. Thereby, the fluctuation in the load of the length measurement roll 101 is not caused.

Figure 3B:
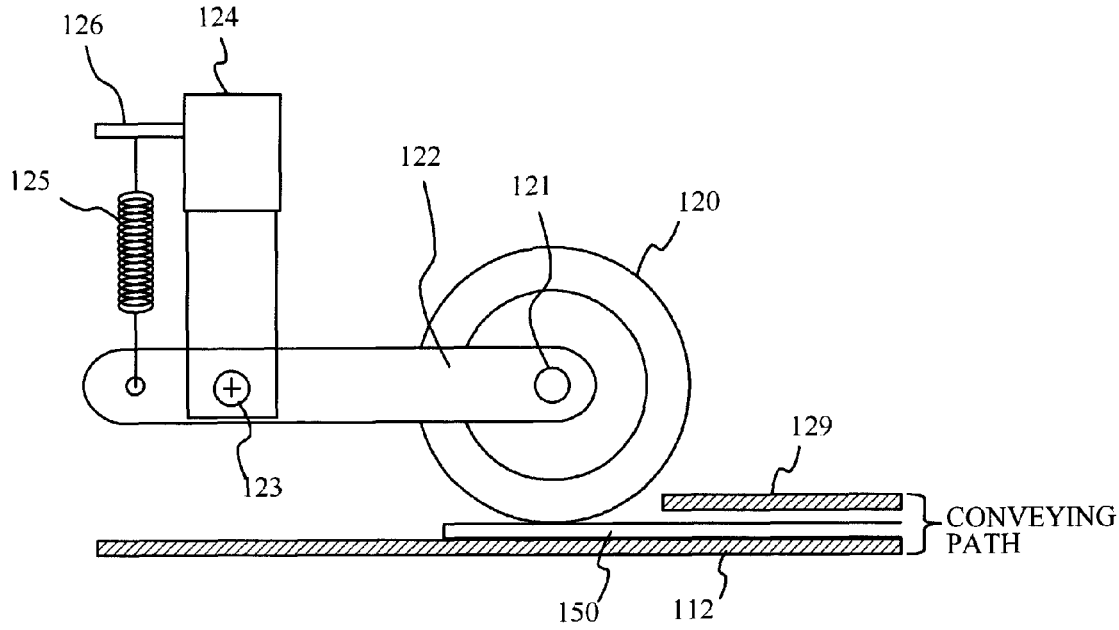

The support member supporting the opposed roll 120 may be configured to provide the swinging arm 122*b* horizontally (i.e., the position in the vertical direction of the rotating shaft 121 is the same as that of the swinging shaft 123) as shown in not only FIG. 3A but also FIG. 3B. The rotating shaft 102 of the length measurement roll 101 is fixed at the fixed position, and the encoder device 103 is provided on the fixed length measurement roll 101, so that the inertia generated to the length measurement roll 101 decreases, and the fluctuation in the load of the length measurement roll 101 is not caused.

(Explanation of an Example of the Construction of the Image Forming Apparatus)

Figure 5:
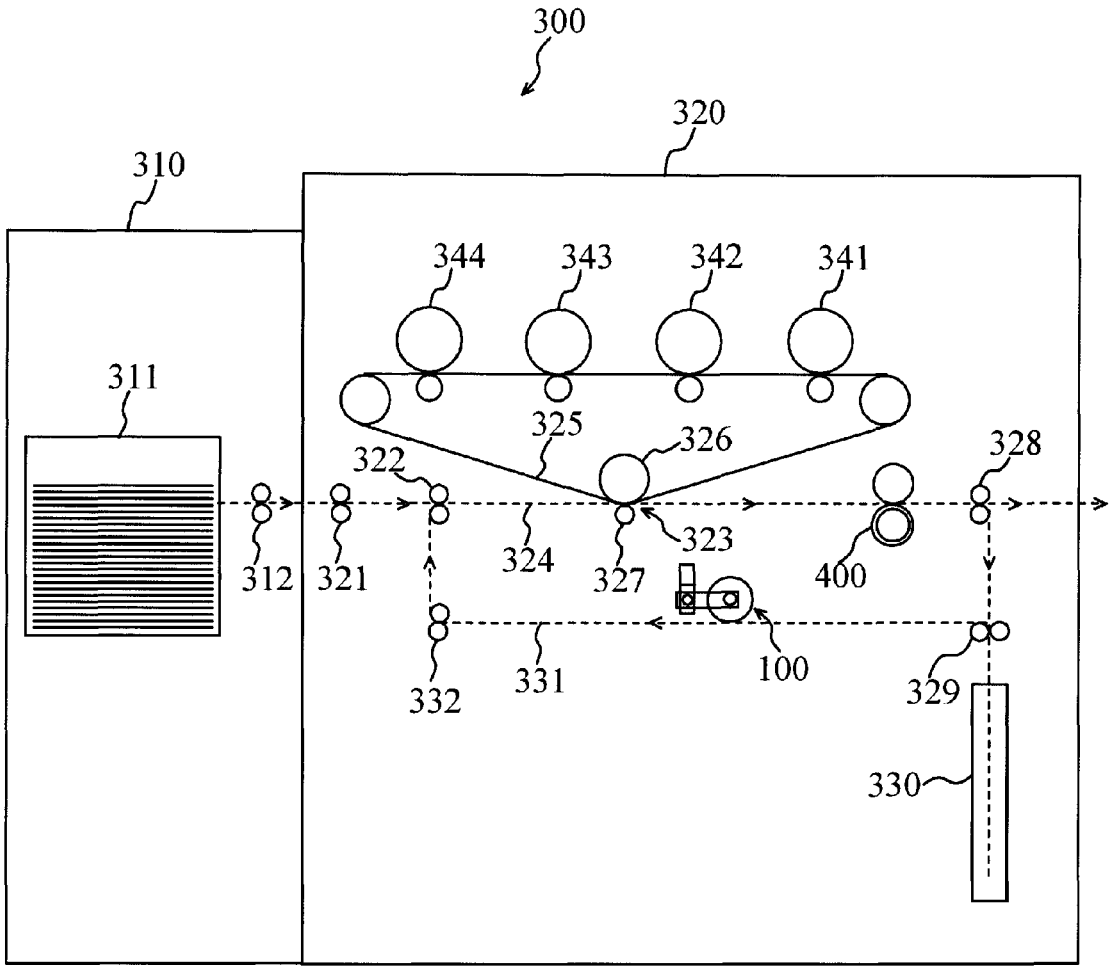
FIG. 5 is a diagram showing an example of a construction of an image forming apparatus.

Next, a description will be given of an image forming apparatus 300 including the sheet length measurement apparatus 100. FIG. 5 shows an example of the image forming apparatus 300 including the sheet length measurement apparatus 100.

the image forming apparatus 300 includes a sheet feeding unit 310 feeding the sheet 150, an image forming unit 320, and a fixing unit 400. In the following, to mainly explain the construction of the image forming apparatus 300, illustrating the main construction of the sheet length measurement apparatus 100 such as the edge sensors 127 and 128, and the conveying rolls 130 and 140 is omitted in FIG. 5.

(Explanation of an Example of the Construction of the Sheet Feeding Unit)

The sheet feeding unit 310 includes a storage device 311 that stores plural sheets, a feeding mechanism (not shown) that feeds a sheet from the storage device 311 in the conveying direction (i.e., a direction of the image forming unit 320), conveying rolls 312 that convey the sheet fed from the feeding mechanism to the image forming unit 320.

(Explanation of an Example of the Construction of the Image Forming Unit)

The image forming unit 320 includes conveying rolls 321 that convey the sheet fed from the sheet feeding unit 310 into the image forming unit 320. Conveying rolls 322, which convey the sheet 150 fed from the conveying rolls 321 or conveying rolls 332 described later toward a secondary transfer unit 323 on a conveying path 324, are disposed at the downstream side of the conveying rolls 321. The secondary transfer unit 323 includes a transfer roll 326 and an opposed roll 327, transfers a toner image formed on a transfer belt 325 onto the sheet 150 by nipping the transfer belt 325 and the sheet 150 between the transfer roll 326 and the opposed roll 327.

A fixing unit 400 having a function that fixes the toner image on the sheet 150 to the sheet 150 by heating and pressurizing, is disposed at the downstream side of the secondary transfer unit 323. Conveying rolls 328 convey the sheet 150 fed from the fixing unit 400 to the outside of the image forming unit 320 or conveying rolls 329.

When images are formed on both surfaces (i.e., first and second surfaces) of the sheet 150, the conveying rolls 328 convey the sheet 150 in a direction of the conveying rolls 329 at the stage where the formation of the image to the first surface of the sheet 150 is terminated. The sheet 150 is temporarily transferred to an inversion device 330 by the conveying rolls 329. The inversion device 330 sends back the conveyed sheet 150 toward the conveying rolls 329. The conveying rolls 329 convey the sheet 150 discharged from the inversion device 330 to a conveying path 331.

Figure 2A:
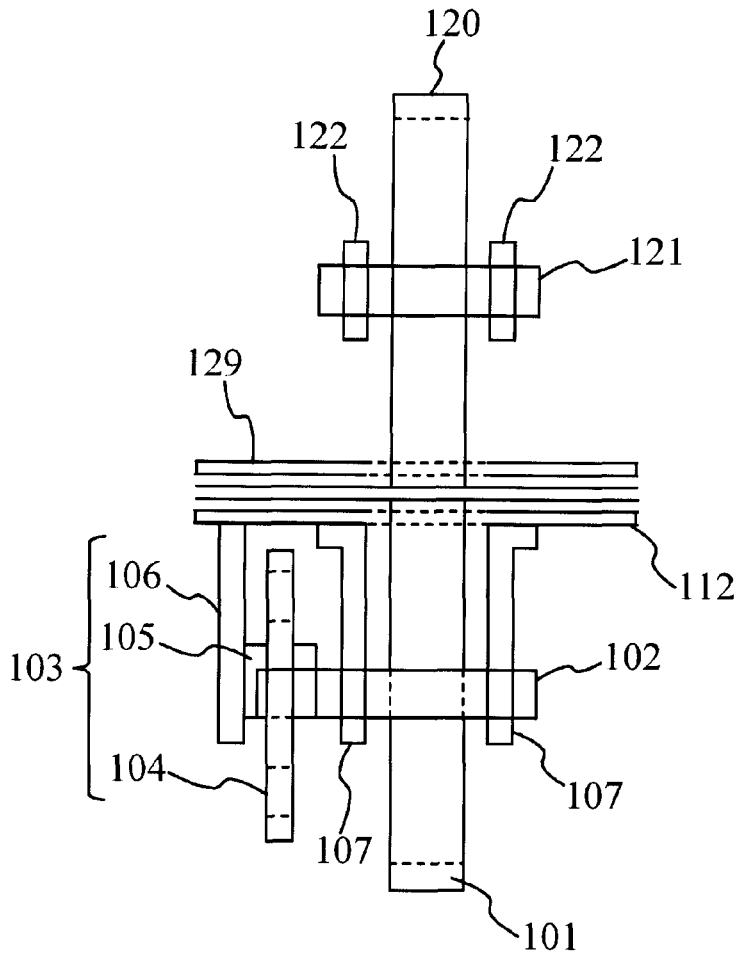
FIG. 2A is a diagram showing configurations of a length measurement roll and an opposed roll, as viewed from a direction of an arrow A shown in FIG. 1.
Figure 2B:
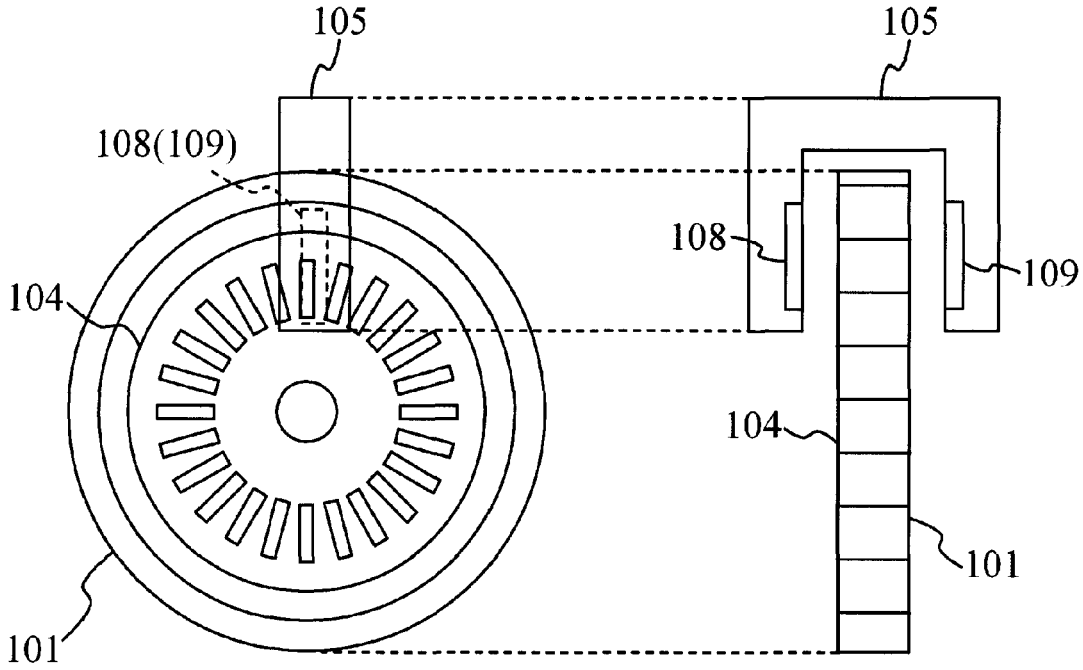
FIG. 2B is a front view and a side view of an encoder wheel and a rotation amount detector.

The sheet length measurement apparatus 100 shown in FIG. 1 is disposed on the conveying path 331. The sheet length measurement apparatus 100 measures the length of the sheet 150 conveyed on the conveying path 331 in the conveying direction. The result of the measurement of the sheet length measurement apparatus 100 is transmitted to the controller 200 shown in FIG. 1. Then, the sheet 150 is conveyed to the conveying path 324 by the conveying rolls 332 and 322. At this time, both surfaces of the sheet 150 are reversed, compared to the case where the sheet 150 is first conveyed on the conveying path 324. The sheet 150 reconveyed on the conveying path 324 is conveyed to the secondary transfer unit 323 again, and the image is transferred onto the second surface which is back of the first surface of the sheet 150.

The control of a primary transfer process and a secondary transfer process of the image formed on the second surface is executed based on information on the length of the sheet in the conveying direction, measured with the sheet length measurement apparatus 100. This is because a phenomenon causing a misalignment of a position of the image formation on the second surface based on the change of the size of the sheet caused by the image formed on the first surface is restrained.

The image forming unit 320 includes primary transfer units 341 to 344. Each of the primary transfer units 341 to 344 includes a photosensitive drum, a cleaning device, an electrifier, an exposure device, a developing device, and transfer rolls. The primary transfer units 341 to 344 superimpose toner images of Y (Yellow), M (Magenta), C (Cyan), and K (Black) on the rotating transfer belt 325, and transfer the toner images onto the rotating transfer belt 325. Thereby, color toner images in which the toner images of the YMCK are superimposed mutually, are formed on the transfer belt 325.

The operation of each component described above is controlled with the controller 200. The controller 200 also executes a measurement process of the sheet length. At the time of the image forming process to the second surface when the images are formed on both surfaces of the sheet, the controller 200 controls the image forming process based on the measured sheet length. It is therefore possible to correct the misalignment of the position of the image formation caused by a difference between the length of both surfaces in the conveying direction of the sheet 150.

In the construction shown in FIG. 5, the sheet length measurement apparatus 100 may be disposed at the upstream of the secondary transfer unit 323 on the conveying path 324, and measure the sheet length in the conveying direction at a stage before the image formation regardless of any one of the surfaces of the sheet, and hence information on the result of the measurement may be used for the image formation.

(Explanation of an Example of the Construction of a Control System)

Next, a description will be given of a control system of the image forming apparatus 300 illustrated in FIG. 5.

Figure 6:
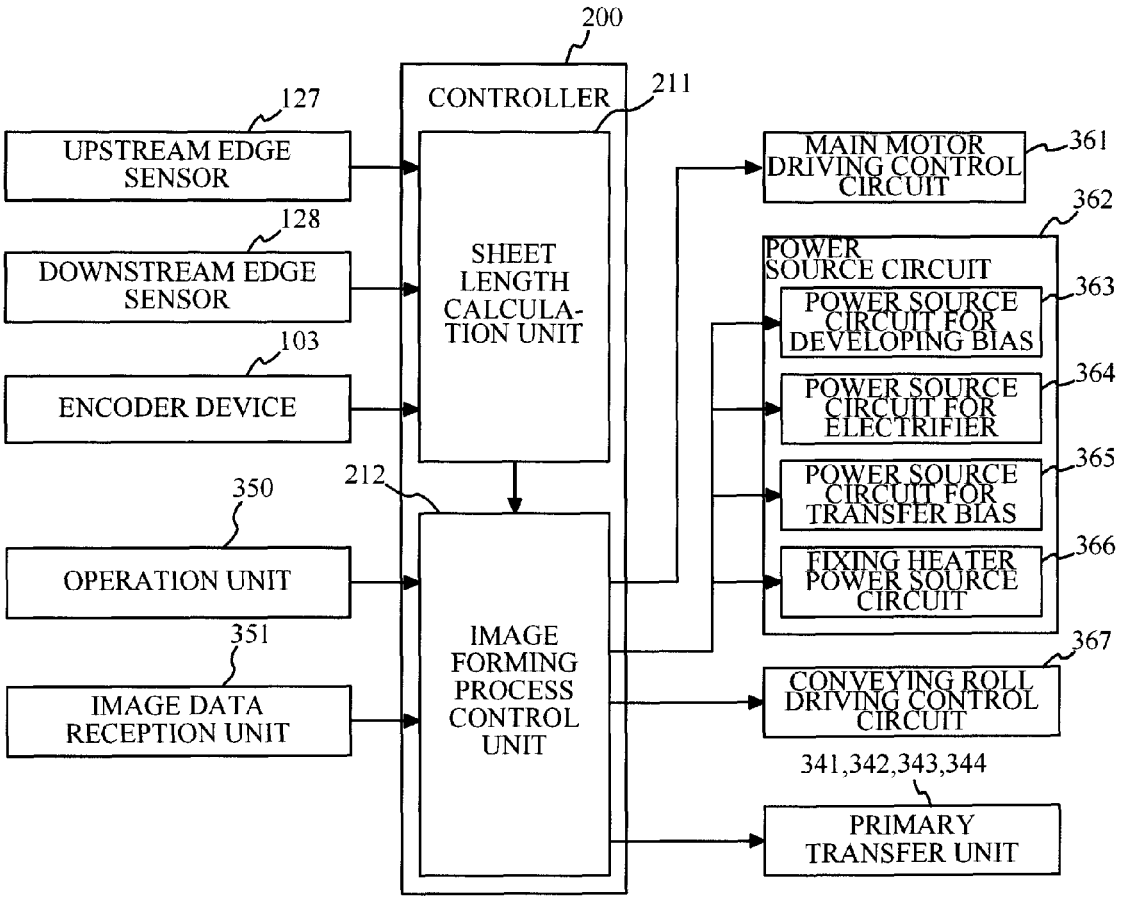
FIG. 6 is a diagram showing an example of the connection of a controller in the image forming apparatus.

First, a description will be given of an example of the connection construction of the controller 200, with reference to FIG. 6. An operation unit 350, an image data reception unit 351, the upstream edge sensor 127, the downstream edge sensor 128, the encoder device 103, and so on are connected to an input unit (i.e., an input and output unit 204 shown in FIG. 7) of the controller 200. A main motor driving control circuit 361, a power source circuit 362, a conveying roll driving control circuit 367, the primary transfer units 341 to 344, and so on are connected to an output unit (i.e., the input and output unit 204 shown in FIG. 7) of the controller 200.

The operation unit 350 receives operation information input by a user. The operation unit 350 outputs the received operation information to the controller 200. The operation information includes settings of one-sided print, double-sided print, the number of print copies, and so on.

The image data reception unit 351 functions as an input unit that receives image data transmitted to the image forming apparatus 300 via a communication line (e.g. Local Area Network), not shown. The image data reception unit 351 outputs the received image data to the controller 200.

Each of the upstream edge sensor 127 and the downstream edge sensor 128 detects the sheet 150 conveyed on the conveying path, and outputs a sensor signal indicative of "ON" while the sheet 150 being detected, to the controller 200. When the length measurement roll 101 rotates, the encoder device 103 generates a pulse signal for each given rotation angle of the length measurement roll 101. The pulse signal generated with the encoder device 103 is also output to the controller.

Next, a description will be given of devices, in which the operation is controlled with the controller 200, executing processes relating to the image formation.

The main motor driving control circuit 361 controls a motor rotating the transfer belt 325 in FIG. 5.

The power source circuit 362 includes a power source circuit for developing bias 363, a power source circuit for electrifier 364, a power source circuit for transfer bias 365, and a fixing heater power source circuit 366. When the toner in the developing device is supplied to the photosensitive drum of each of the primary transfer units 341 to 344, the power source circuit for developing bias 363 generates a bias voltage supplied to the developing device. The power source circuit for electrifier 364 electrifies the photosensitive drum of each of the primary transfer units 341 to 344. The power source circuit for transfer bias 365 generates a bias voltage applied to each of the primary transfer units 341 to 344 at the time of the primary transfer to the transfer belt 325, and a bias voltage supplied to the transfer roll 326 at the time of the secondary transfer in the secondary transfer unit 323. The fixing heater power source circuit 366 supplies a power source to a heater included in the fixing unit 400.

A conveying roll driving control circuit 367 drives a motor rotating the rolls of a conveying mechanism for conveying the sheet, such as the conveying rolls 322.

Figure 7:
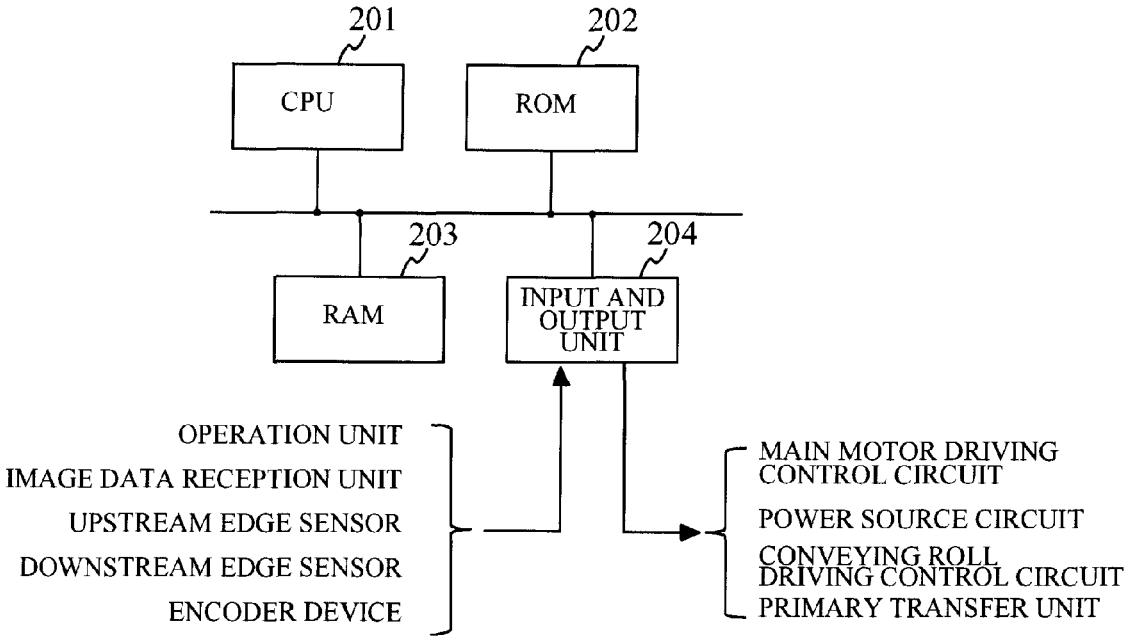
FIG. 7 is a diagram showing an example of a hardware construction of the controller.

Next, a description will be given of the hardware construction of the controller 200, with reference to FIG. 7. FIG. 7 shows an example of the hardware construction of the controller 200. The controller 200 includes a CPU (Central Processing Unit) 201, a ROM (Read Only Memory) 202, a RAM (Random Access Memory) 203, and the input and output unit 204. A program which the CPU 201 uses for the control is stored into the ROM 202. The CPU 201 reads out the program stored into the ROM 202, and stores the read-out program into the RAM 203. Then, the CPU 201 executes the process according to the program stored into the RAM 203. The RAM 203 is used as a working area storing data that the CPU 201 uses for calculation, data on the result of the calculation, and so on. The input and output unit 204 inputs data output from the operation unit 350, the image data reception unit 351, the upstream edge sensor 127, the downstream edge sensor 128, the encoder device 103, and so on, as shown in FIG. 6. The input and output unit 204 also outputs control signals generated with the CPU 201 to the main motor driving control circuit 361, the power source circuit 362, the conveying roll driving control circuit 367, and the primary transfer units 341 to 344.

Next, a description will be given of functional blocks of the controller 200 achieved by program control, with reference to FIG. 6. The controller 200 includes a sheet length calculation unit 211, and an image forming process control unit 212 as functional blocks. These functional blocks are achieved by the cooperation of the program stored into the ROM 202, and the hardware such as the CPU 201 and the RAM 203.

The sheet length calculation unit 211 has a calculating function that calculates the sheet length, and stores data to be processed by the calculating function into the RAM 203. The RAM 203 stores data on a rotational amount of the length measurement roll 101, data on the size of the length measurement roll 101, information output from the upstream edge sensor 127 and the downstream edge sensor 128, information on a distance between the upstream edge sensor 127 and the downstream edge sensor 128, and so on.

The image forming process control unit 212 controls the processes relating to the image formation. The main motor driving control circuit 361, the power source circuit 362, the conveying roll driving control circuit 367, and the primary transfer units 341 to 344 are included in controlled objects of the image forming process control unit 212.

(Explanation of Calculating Procedures of Sheet Length by Controller)

Figure 8:
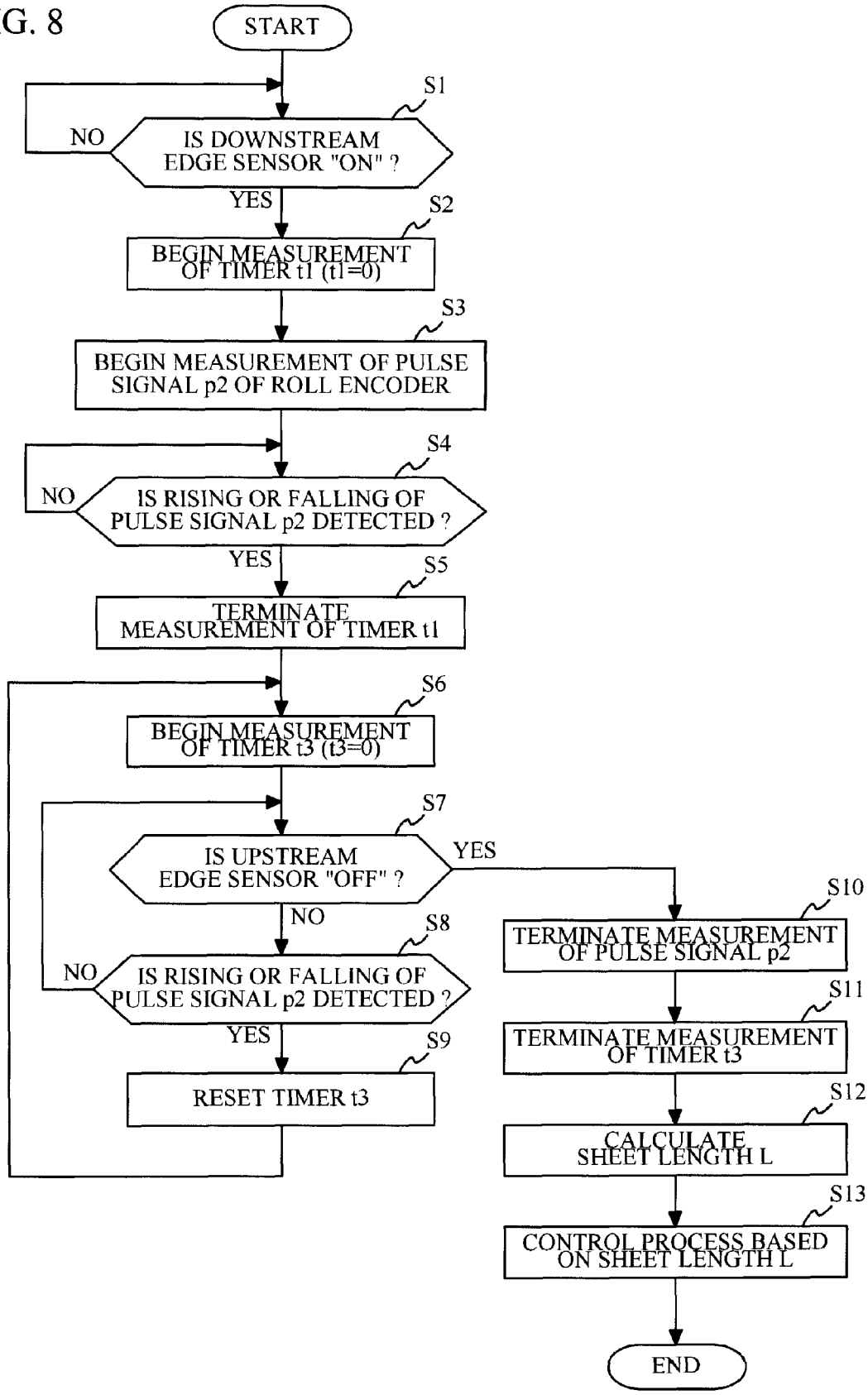
FIG. 8 is a flowchart showing measurement procedures of the sheet length with the controller.
Figure 9A:
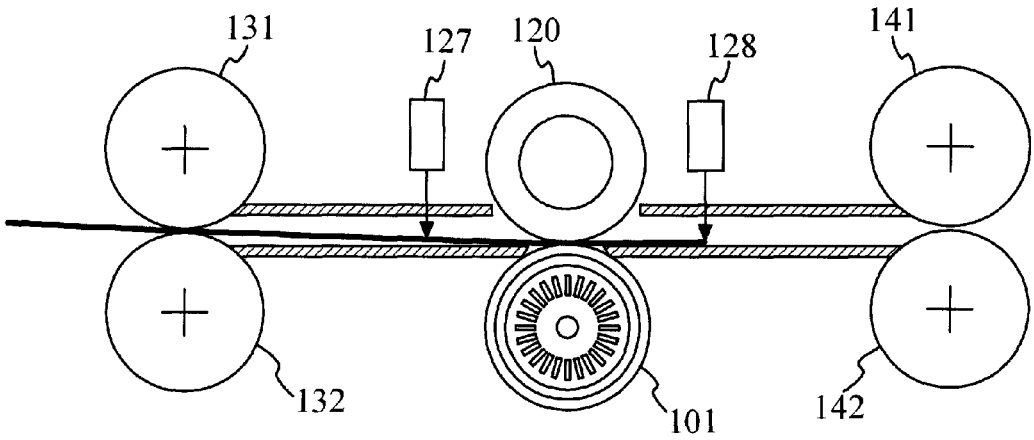
FIGS. 9A and 9B are diagrams useful in explaining a calculating method of the sheet length with the controller when a front edge of the sheet reaches a downstream edge sensor and when a rear edge of the sheet comes out of an upstream edge sensor, respectively.
Figure 9B:
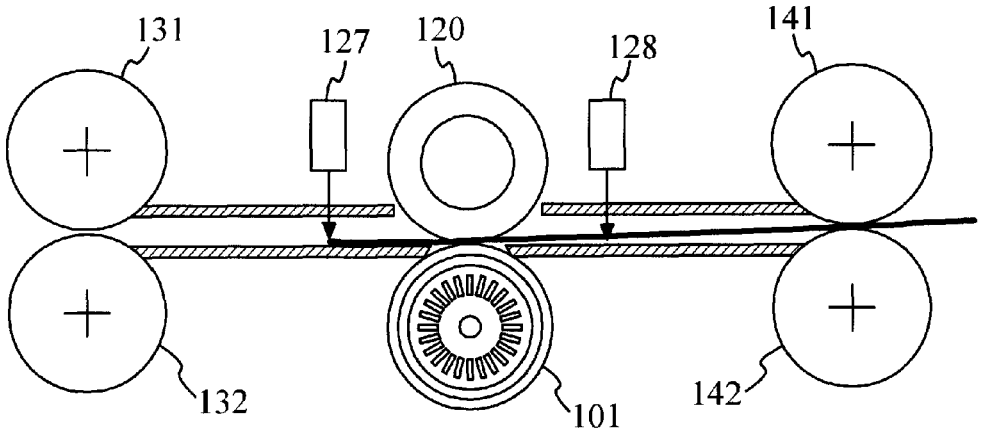

Next, a description will be given of an example of control operation of the controller 200, with reference to a flowchart shown in FIG. 8. Here, a description will be given of an example of a calculating process of the sheet length executed before the image formation to the second surface when the images are formed on both surfaces of the sheet 150.

When the images are formed on both surfaces of the sheet 150, the sheet is switched back at the inversion device 330, and conveyed to the conveying path 331 after the image formation to the first surface is executed. At this timing, a process shown in FIG. 8 is started.

The controller 200 first judges whether the sensor signal of the downstream edge sensor 128 is "ON" (step S1). When the sensor signal of the downstream edge sensor 128 is "ON" (YES in step S1), the controller 200 proceeds to step S2. When the sensor signal of the downstream edge sensor 128 is not "ON" (NO in step S1), the controller 200 repeatedly executes the procedure of step S1. The sensor signal of the downstream edge sensor 128 showing "ON" indicates a state where the front edge of the sheet 150 has reached a detection position of the downstream edge sensor 128.

When the downstream edge sensor 128 detects the sheet 150 (YES in step S1), the controller 200 begins the measurement of the timer t1 (step S2). The controller 200 begins the measurement of a pulse signal p2 output from the encoder device 103 in time with the beginning of the measurement of the timer t1 (step S3). Then, when the controller 200 detects the change of a signal level of the pulse signal p2 (step S4), the controller 200 terminates the measurement of the timer t1 (step S5). At this time, the controller 200 acquires a count value of the timer t1 as a measurement parameter t1, and stores the measurement parameter t1 into the RAM 203.

Next, the controller 200 begins the measurement of the timer t3 from a state of "t3=0" (step S6), and judges whether the sensor signal output from the upstream edge sensor 127 is "OFF", i.e., the sheet 150 has passed through the detection position of the upstream edge sensor 127 (step S7). When the sensor signal output from the upstream edge sensor 127 is "OFF" (YES in step S7), the controller 200 terminates the measurement of the pulse signal p2 (step S10). In addition, the controller 200 terminates the measurement of the timer t3 (step S11). At this time, the controller 200 acquires a count value of the timer t3 as a measurement parameter t3, and stores the measurement parameter t3 into the RAM 203.

On the other hand, when the sensor signal output from the upstream edge sensor 127 is not "OFF" (NO in step S7), the controller 200 judges whether the change of the signal level of the pulse signal p2 is detected (step S8). When the change of the signal level of the pulse signal p2 is detected (YES in step S8), the controller 200 resets the timer t3 (step S9), returns to step S6, and begins the measurement of the timer t3 again. When the change of the signal level of the pulse signal p2 is not detected (NO in step S8), the controller 200 repeatedly executes the judgment of steps S7 and S8.

After step S11, the controller 200 calculates a sheet length L (step S12). The controller 200 calculates the sheet length L by totaling the values of sheet lengths L1 to L4 described later. The controller 200 adjusts a position of the image formed on the second surface of the sheet 150, based on the calculated sheet length L (step S13).

Here, a description will be given of the sheet lengths L1 to L4, with reference to FIGS. 7 to 9B. First, the sheet length L2 will be described. The sheet length L2 is a sheet length which the controller 200 calculates based on the number of the counted pulse signals p2 output from the encoder device 103 while both of the upstream edge sensor 127 and the downstream edge sensor 128 are detecting the sheet 150 (hereinafter referred to as a measurement period). The pulse signals are not steady at a while even if the front edge of the sheet 150 begins to come in contact with the length measurement roll 101. Therefore, the measurement beginning timing of the measurement period is timing when the front edge of the sheet 150 reaches the detection position of the downstream edge sensor 128, and the sensor signal of the downstream edge sensor 128 becomes "ON" (see FIG. 9A). The length measurement roll 101 may rotate by inertia after the length measurement roll 101 finishes coming in contact with the sheet 150. Therefore, even if the pulse signals are continuously detected, the controller 200 finishes counting the pulse signals in timing that a rear edge of the sheet 150 comes free from the detection position of the upstream edge sensor 127. That is, the measurement finish timing of the measurement period is timing when the rear edge of the sheet 150 comes free from the detection position of the upstream edge sensor 127, and the sensor signal of the upstream edge sensor 127 becomes "OFF" (see FIG. 9B). The controller 200 calculates the sheet length L2 from the number of the counted pulse signals p2 at the measurement period.

The sheet length L4 is a distance between the upstream edge sensor 127 and the downstream edge sensor 128. As described above, the measurement of the sheet length by using the encoder device 103 is executed after the front edge of the sheet 150 reaches the detection position of the downstream edge sensor 128. Also, the measurement of the sheet length by using the encoder device 103 is not executed after the rear edge of the sheet 150 comes free from the detection position of the upstream edge sensor 127. Thereby, it is necessary to add to the sheet lengths L2 and L4 a distance from the measurement position of the length measurement roll 101 to the downstream edge sensor 128 before the measurement by the encoder device 103, and a distance from the upstream edge sensor 127 to the measurement position of the length measurement roll 101 after the measurement by the encoder device 103.

Figure 10A:
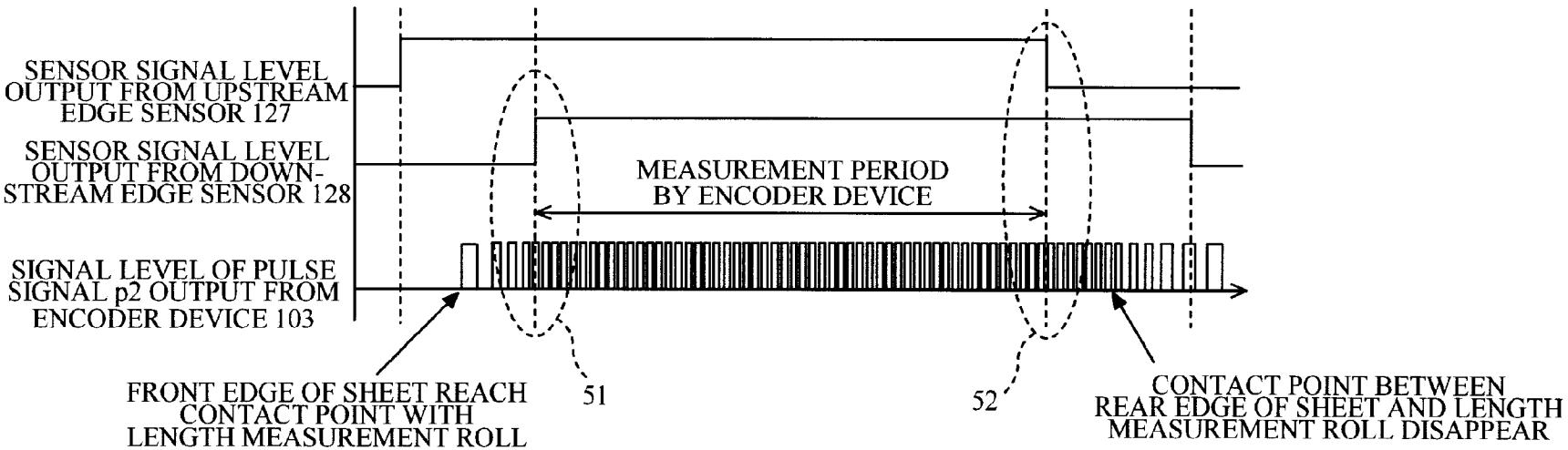
FIGS. 10A to 10C are diagrams useful in explaining the calculating method of the sheet length with the controller.
Figure 10B:
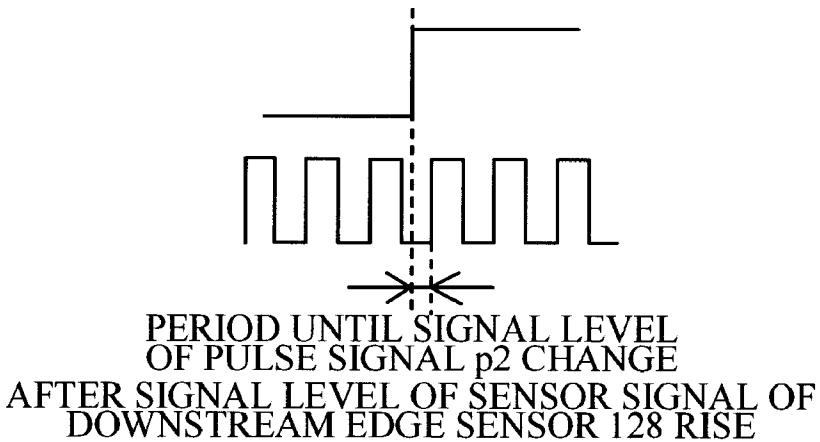
Figure 10C:
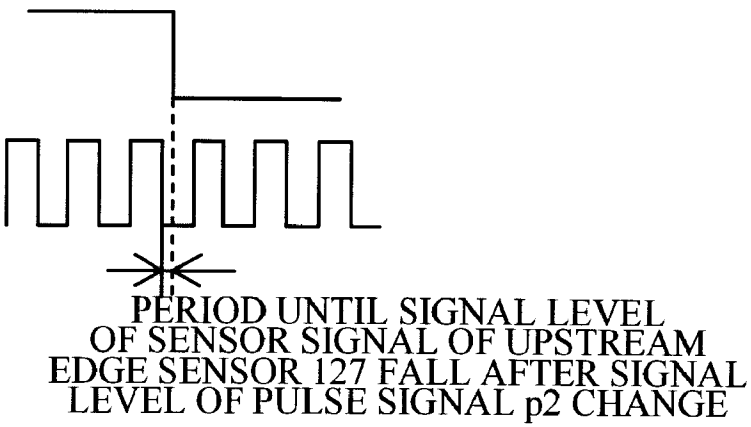

The sheet lengths L1 and L3 are values for correcting measurement errors by the encoder device 103. A description will be given of the measurement error, with reference to FIGS. 10A to 10C. FIG. 10A shows a signal waveform of the pulse signal p2 output from the encoder device 103, a signal level of the sensor signal of the upstream edge sensor 127, and a signal level of the sensor signal of the downstream edge sensor 128. FIG. 10B is an enlarged view of an area 50 in FIG. 10A, and FIG. 10C is an enlarged view of an area 51 in FIG. 10A. In FIG. 10B, the pulse signal p2 in the vicinity where the sensor signal of the downstream edge sensor 128 becomes "ON", and the sensor signal of the downstream edge sensor 128 are shown exaggeratingly. Similarly, in FIG. 10C, the pulse signal p2 in the vicinity where the sensor signal of the upstream edge sensor 127 becomes "OFF", and the sensor signal of the upstream edge sensor 127 are shown exaggeratingly.

As shown in FIGS. 10A and 10B, there is a misalignment between timing when the front edge of the sheet 150 reaches the detection position of the downstream edge sensor 128, and the sensor signal of the downstream edge sensor 128 becomes "ON", and timing when the signal level of the pulse signal p2 output from the encoder device 103 changes (i.e., the signal level of the pulse signal p2 rises). The misalignment occurs due to the resolution of the encoder device 103. A period between timing when the sensor signal of the downstream edge sensor 128 becomes "ON", and timing when the signal level of the pulse signal p2 changes is a measurement value of the timer t1, described above. The controller 200 calculates the sheet length L1 based on the measurement value of the timer t1.

Similarly, there is a misalignment between timing when the rear edge of the sheet 150 comes free from the detection position of the upstream edge sensor 127, and the sensor signal of the upstream edge sensor 127 becomes "OFF", and timing when the signal level of the pulse signal p2 output from the encoder device 103 changes (i.e., the signal level of the pulse signal p2 falls). A period between timing when the sensor signal of the upstream edge sensor 127 becomes "OFF", and timing when the signal level of the pulse signal p2 changes is a measurement value of the timer t3, described above. The controller 200 calculates the sheet length L3 based on the measurement value of the timer t3.

Figure 11:
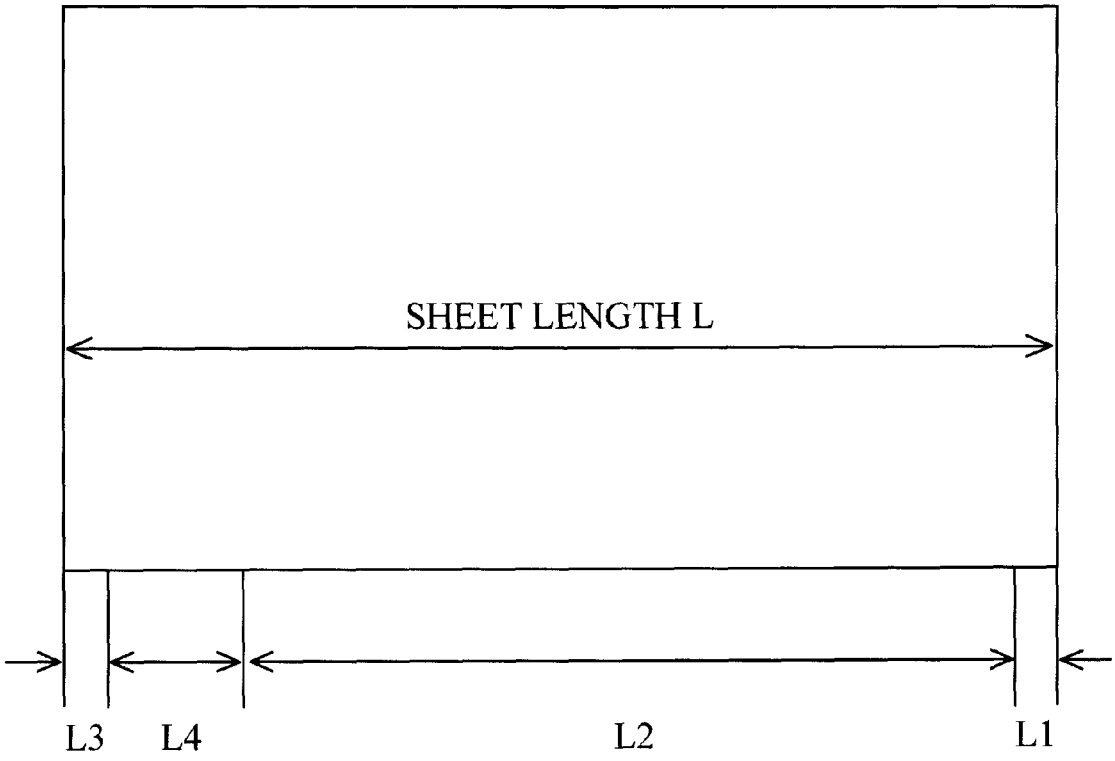
FIG. 11 is a diagram useful in explaining the calculating method of the sheet length with the controller.

The controller 200 first calculates the sheet length L2 based on the number of the counted pulse signals p2 at the measurement period. Also, the controller 200 calculates the sheet length L1 by multiplying the measurement value of the timer t1 by a setting value V of the conveying speed of the sheet 150. Similarly, the controller 200 calculates the sheet length L3 by multiplying the measurement value of the timer t3 by the setting value V of the conveying speed of the sheet 150. Then, the controller 200 calculates the sheet length L by adding the value of the distance between the upstream edge sensor 127 and the downstream edge sensor 128 stored into the RAM 203 to a value to which the calculated sheet lengths L1 to L3 are added up. FIG. 11 shows a state where the sheet length L is calculated by adding up the sheet lengths L1 to L4.

Variation Exemplary Embodiment 1

In the sheet length measurement apparatus 100 shown in FIGS. 1 to 3, the opposed roll 120 is shown as the opposed member that is opposed to the length measurement roll 101, and comes in contact with the length measurement roll 101 by a given nip pressure. However, the opposed member may be any member that can comes in contact with the length measurement roll 101 by the given nip pressure, and may be a pad 160 shown in FIG. 12, for example.

When the pad 160 is used as the opposed member, friction occurs between the pad 160 and the sheet 150. It is therefore desirable that a pad having a small frictional coefficient as much as possible is used as the pad 160. It should be noted that, when the opposed roll 120 is used as the opposed member as in the case of the exemplary embodiment described above, the friction when the opposed roll 120 comes in contact with the sheet 150 can reduce.

Figure 12:
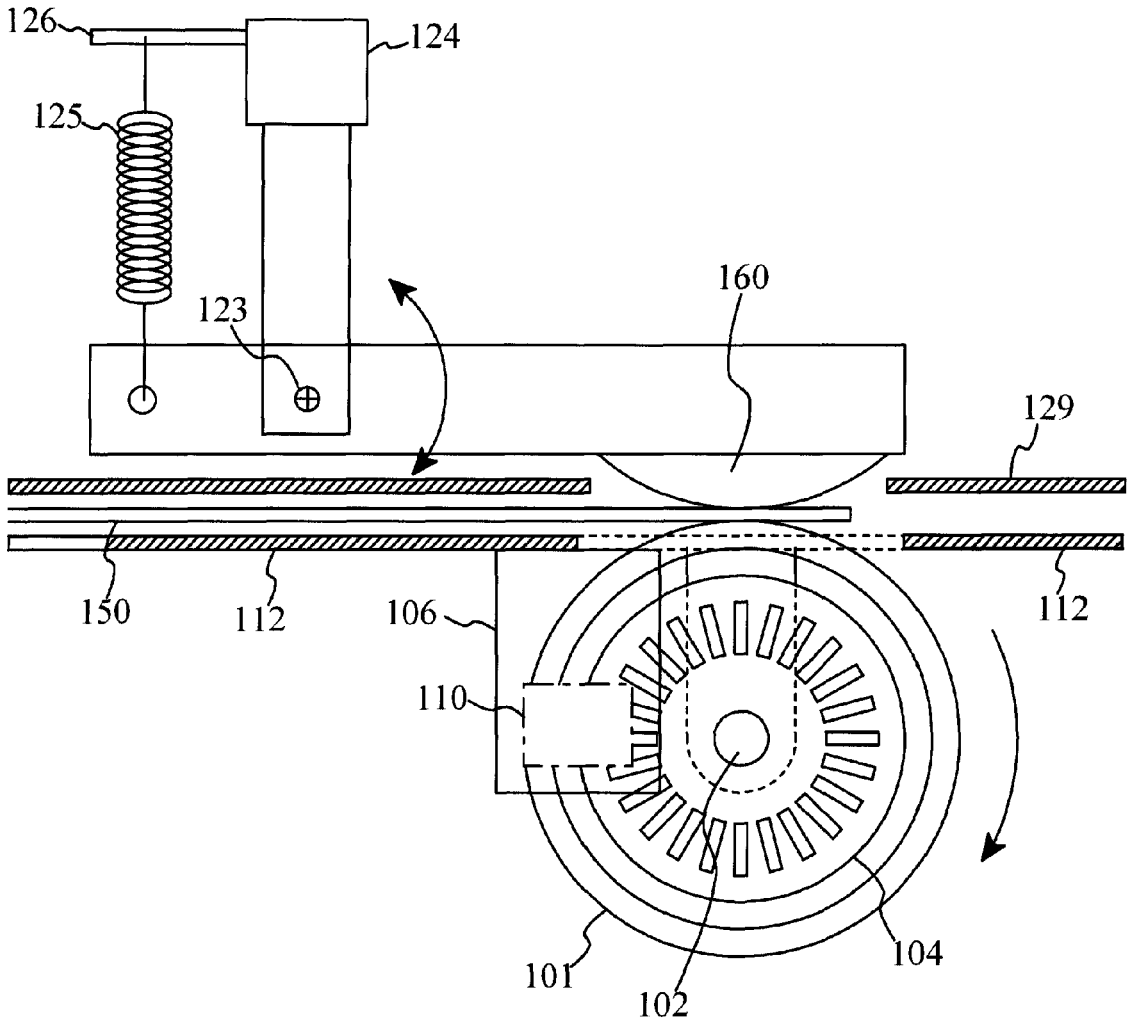
FIG. 12 is a diagram showing an example of a construction in which a pad is provided as an opposed member opposed to the length measurement roll.

In an example shown in FIG. 12, the sheet 150 is conveyed by the upstream conveying roll 130, and conveyed to a position (hereinafter referred to as the contact position) where the sheet 150 is brought into contact with the length measurement roll 101 and the pad 160 as the opposed member. When the sheet 150 goes into the contact position of the length measurement roll 101 and the pad 160, the length measurement roll 101 rotates, and the pad 160 moves upward by the thickness of the sheet 150. The pad 160 holds the sheet 150 between the length measurement roll 101 and the pad 160, by an urging force of the coil spring 125, and presses the sheet 150 against the length measurement roll 101 by the given nip pressure. The length measurement roll 101 rotates along with the conveyance of the sheet 150 nipped between the pad 160 and the length measurement roll 101.

Variation Exemplary Embodiment 2

Figure 13:
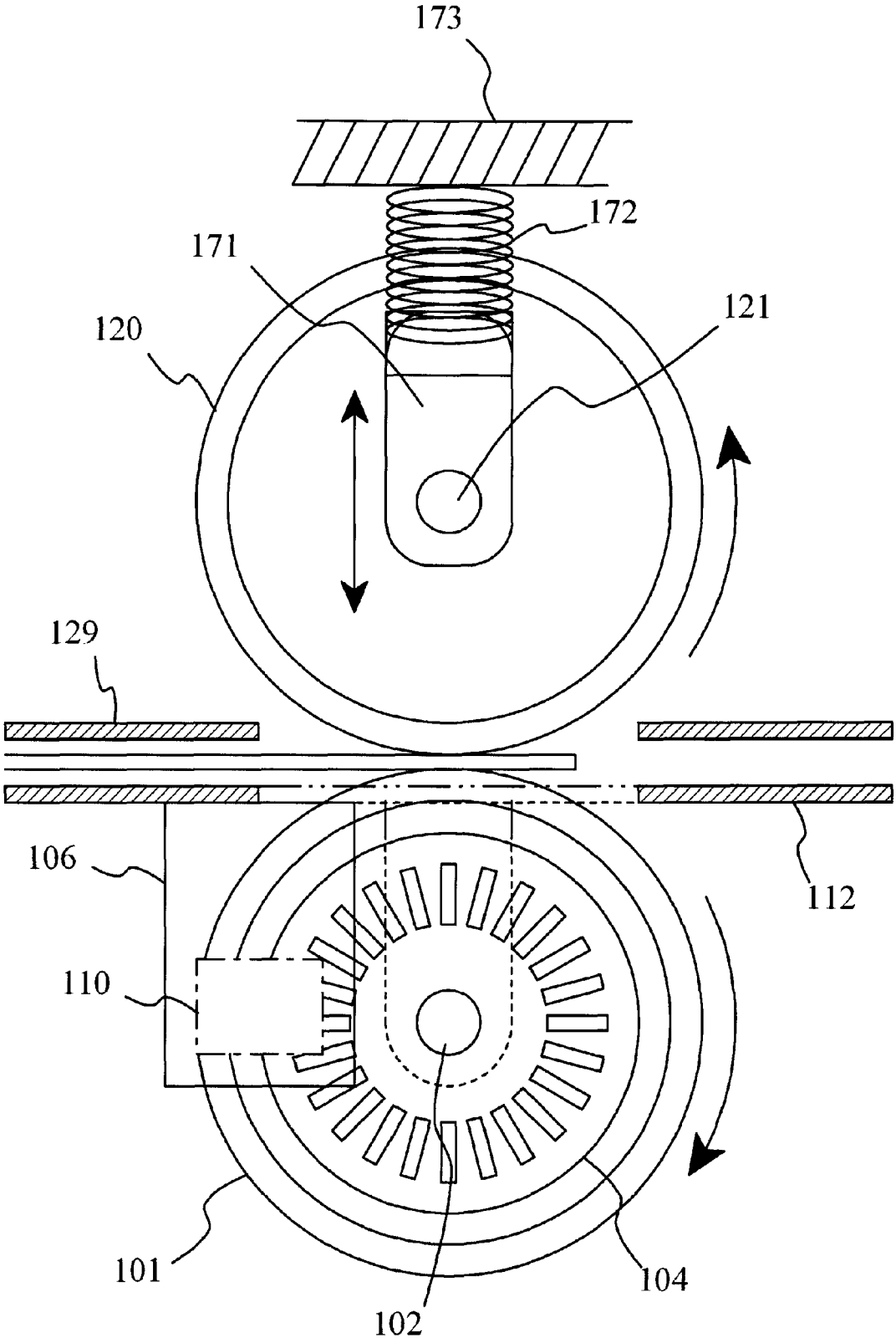
FIG. 13 is a diagram showing an example of a construction in which a support arm supporting the opposed member is provided in a vertical direction.

In a variation example shown in FIG. 13, a support arm 171 supporting the opposed roll 120, and a coil spring 172 are installed perpendicular to the surface of the sheet 150. One end of the support arm 171 is attached to the rotating shaft 121 of the opposed roll 120, and another end of the support arm 171 is attached to one end of the coil spring 172. Another end of the coil spring 172, which is opposite to the one end thereof to which the support arm 171 is attached, is fixed to a housing 173 of the sheet length measurement apparatus 100.

In the variation example, when the opposed roll 120 moves up and down by a force received from the conveyed sheet 150 (the movement of a vertical direction to the surface of the sheet 150 will hereinafter be referred to as "up-and-down movement"), the support arm 171 also moves up and down in conformity with the up-and-down movement of the opposed roll 120. The up-and-down movement of the opposed roll 120 and the support arm 171 are absorbed by the coil spring 172. Unlike the case where the opposed roll 120 is swingably supported as in the case of the exemplary embodiment described above, the opposed roll 120 merely moves up and down by a force received from the sheet 150, and does not move to the conveying direction of the sheet 150. Therefore, the change of the nip pressure between the opposed roll 120 and the length measurement roll 101 can be small, compared to the case where the opposed roll 120 is swingably supported.

Figure 14:
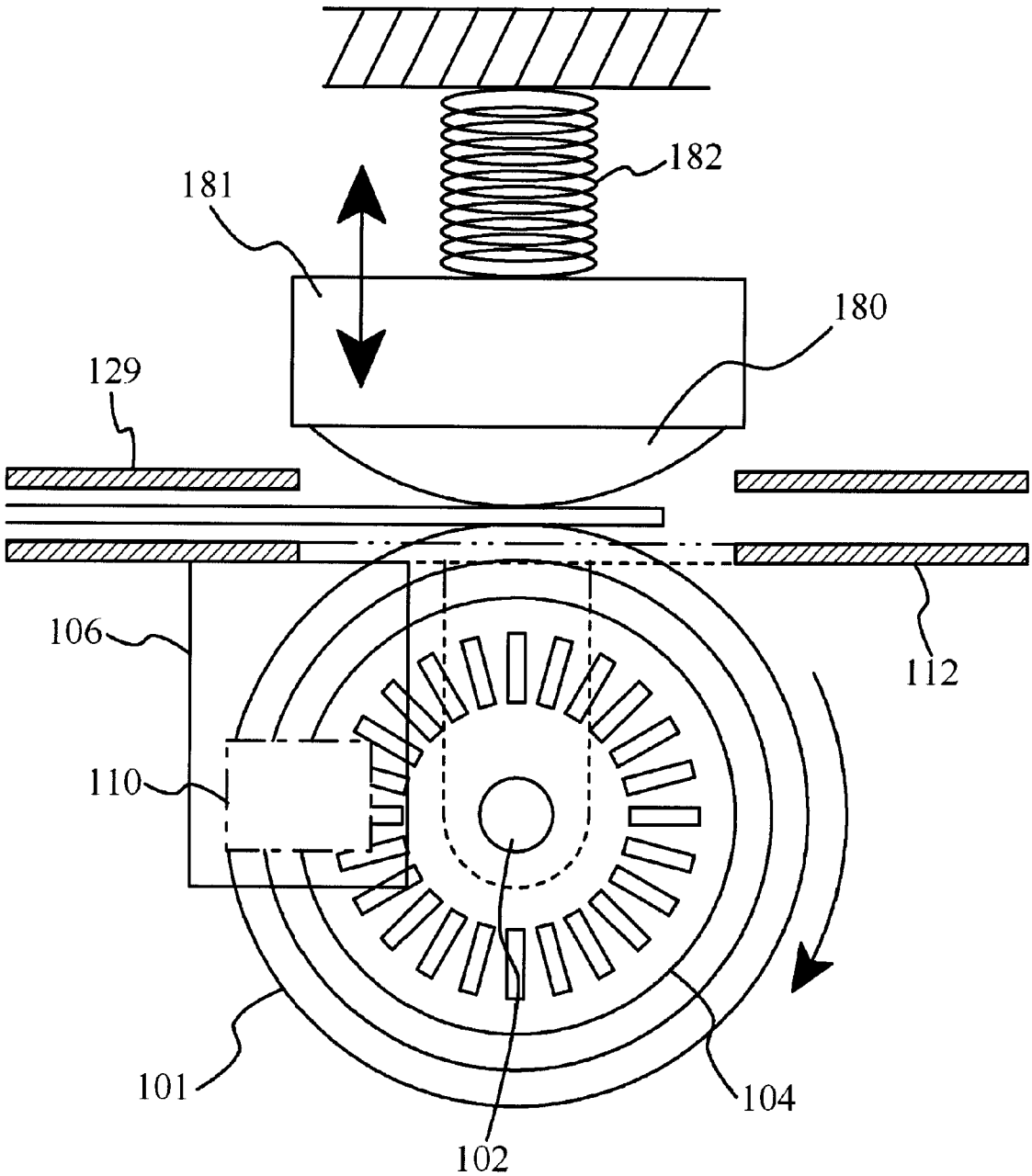
FIG. 14 is a diagram showing an example of a construction in which the support arm supporting the opposed member is provided in the vertical direction, and a pad is provided on the opposed member.

It should be noted that a pad 180 may be provided instead of the opposed roll 120, as shown in FIG. 14. In the example shown in FIG. 14, the pad 180, and a support member 181 supporting the pad 180 also move up and down in conformity with the up-and-down movement of the sheet 150. The up-and-down movement is absorbed by a coil spring 182 attached to the support member 181.

In the exemplary embodiment described above, although the opposed roll 120 and the length measurement roll 101 are provided above and below the conveying path, respectively, as shown in FIG. 1, the length measurement roll 101 and the opposed roll 120 may be provided above and below the conveying path, respectively, The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The exemplary embodiments were chosen and described in order to best explain the principles of the invention and its practical applications, thereby enabling others skilled in the art to understand the invention for various exemplary embodiments and with the various modifications as are suited to the particular use contemplated. It is intended that the scope of the invention be defined by the following claims and their equivalents.

What is claimed is:

1. A sheet length measurement apparatus comprising:

a rotating member that comes in contact with a recording sheet conveyed on a conveying path, and rotates along with the conveyance of the recording sheet;

a rotation amount detector that detects a rotational amount of the rotating member;

a fixing support member that fixedly supports an rotating shaft of the rotating member at a fixed position;

an opposed member that is disposed opposite to the rotating member so as to hold the recording sheet between the rotating member and the opposed member, the opposed member being disposed so that the rotating member rotates along with the conveyance of the recording sheet; and a support member that supports the opposed member in a movable state in a direction to separate from or come in contact with a surface of the recording sheet.

2. The sheet length measurement apparatus according to claim 1, wherein the support member is a swinging support member that swingably supports the opposed member by centering on a swinging shaft, and a position in a vertical direction of the swinging shaft of the swinging support member, which is perpendicular to the surface of the recording sheet conveyed on the conveying path, is identical with a position in a vertical direction of a joint point of the swinging support member and the opposed roll, or is nearer to the rotating member than the joint point in the vertical direction.

3. The sheet length measurement apparatus according to claim 1, wherein the support member is a vertical movement support member that supports the opposed member in a movable state in a vertical direction to the surface of the recording sheet.

4. The sheet length measurement apparatus according to claim 1, wherein the opposed member is a roll member that rotates along with the conveyance of the recording sheet.

5. The sheet length measurement apparatus according to claim 1, further comprising:

sheet detectors that are provided at an upstream side and a downstream side of the rotating member in a conveying direction of the recording sheet, and detect the recording sheet; and a sheet length calculator that calculates a length of the recording sheet based on the detection results of the sheet detectors and the rotational amount of the rotating member detected by a rotation amount detector.

6. An image forming apparatus comprising:

a sheet length measurement apparatus including:

a rotating member that comes in contact with a recording sheet conveyed on a conveying path, and rotates along with the conveyance of the recording sheet;

a rotation amount detector that detects a rotational amount of the rotating member;

a fixing support member that fixedly supports an rotating shaft of the rotating member at a fixed position;

an opposed member that is disposed opposite to the rotating member so as to hold the recording sheet between the rotating member and the opposed member, the opposed member being disposed so that the rotating member rotates along with the conveyance of the recording sheet; and a support member that supports the opposed member in a movable state in a direction to separate from or come in contact with a surface of the recording sheet; and an image forming portion that controls a forming condition of an image to be formed on the recording sheet, based on an output of the sheet length measurement apparatus.

* * * * *